US010137495B2

(12) United States Patent
Faoro

(10) Patent No.: US 10,137,495 B2
(45) Date of Patent: Nov. 27, 2018

(54) MACHINE FOR FORMING METAL BARS

(71) Applicant: IKOI S.R.L., San Zeno di Cassola (IT)

(72) Inventor: Giovanni Faoro, Bassano del Grappa (IT)

(73) Assignee: IKOI S.P.A., Cassola (VI) (IT)

( * ) Notice: Subject to any disclaimer, the term of this patent is extended or adjusted under 35 U.S.C. 154(b) by 0 days.

(21) Appl. No.: 15/882,469

(22) Filed: Jan. 29, 2018

(65) Prior Publication Data

US 2018/0147623 A1 May 31, 2018

Related U.S. Application Data

(60) Continuation of application No. 14/859,570, filed on Sep. 21, 2015, which is a division of application No.
(Continued)

(30) Foreign Application Priority Data

Apr. 1, 2011 (IT) ..... VI2011A0076

(51) Int. Cl.
*B22D 9/00* (2006.01)
*B22D 7/00* (2006.01)
(Continued)

(52) U.S. Cl.
CPC ..... *B22D 9/003* (2013.01); *B22D 7/00* (2013.01); *B22D 7/005* (2013.01); *B22D 7/06* (2013.01);
(Continued)

(58) Field of Classification Search
CPC ..... B22D 9/003; B22D 23/06; B22D 7/00; B22D 7/06
See application file for complete search history.

(56) References Cited

U.S. PATENT DOCUMENTS

2001/0050157 A1 12/2001 Drown
2007/0289715 A1 12/2007 Crafton et al.

FOREIGN PATENT DOCUMENTS

DE 200 12 066 U1 12/2001
JP 4 305359 A 10/1992

OTHER PUBLICATIONS

International Search Report of PCT/EP2012/001377 dated Jul. 10, 2012.
(Continued)

*Primary Examiner* — Kevin P Kerns
*Assistant Examiner* — Steven S Ha
(74) *Attorney, Agent, or Firm* — Bucknam and Archer

(57) ABSTRACT

A machine for forming metal bars, in particular for producing ingots made of precious metal such as gold, silver, precious alloys, as well as other pure metals or different alloys, in the form of solid metal powder, grits or swarf of various sizes, having an ingot mold and a cover for closing the ingot mold when filled, the ingot mold has a dimension in height such that the cover passes from a first position to a second position when the volume occupied by the mass of metal that fills the ingot mold reduces gradually up to one third of the initial solid volume. In the first position the cover rests on the metal that fills the ingot mold and remains raised with respect to an abutting edge of the ingot mold, in such a manner that the bottom of the cover compresses and thus uniformly compacts the powders, the grits or the swarf so that, during the melting step, in the second position, the cover lowers progressively as the metal melts, until it rests on the abutting edge of the ingot mold, thus hermetically closing the ingot mold.

1 Claim, 1 Drawing Sheet

Related U.S. Application Data

Figures 1, 2:
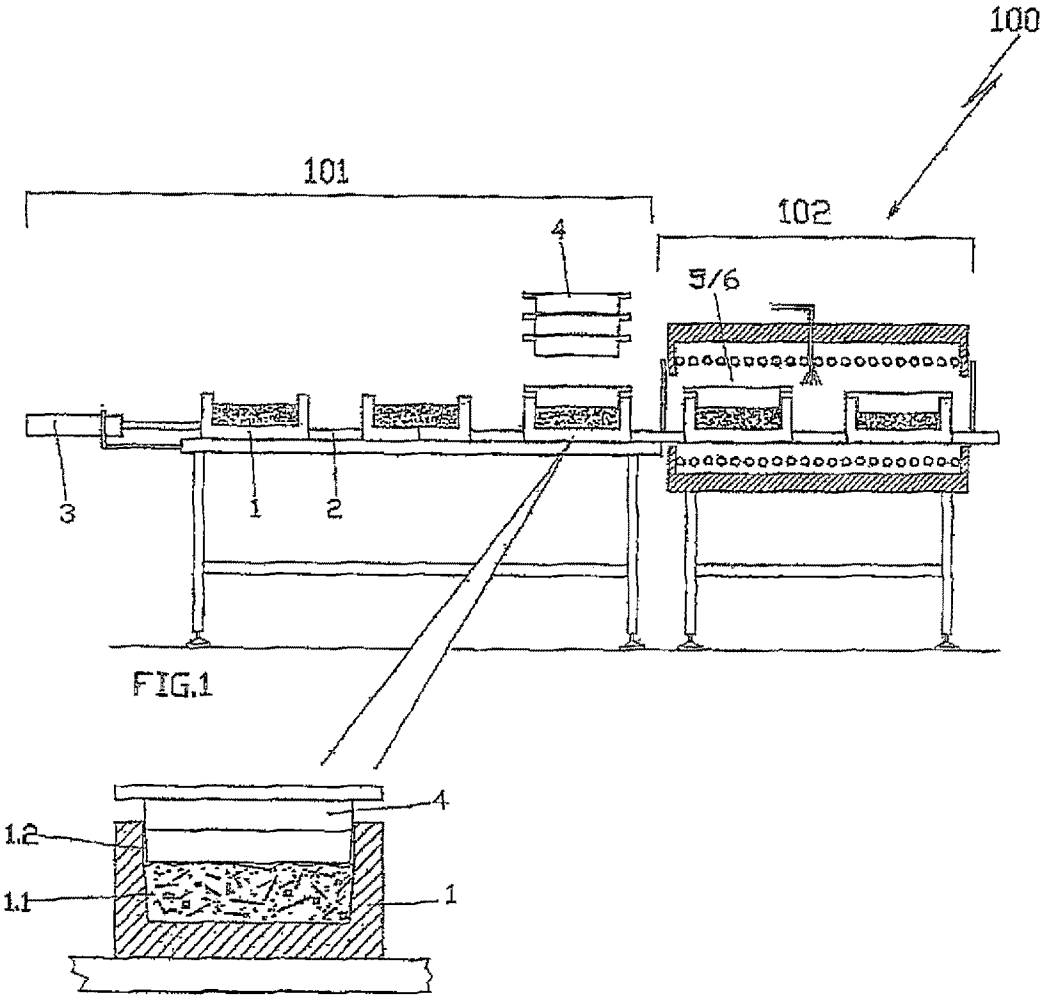

14/007,910, filed as application No. PCT/EP2012/001377 on Mar. 29, 2012, now Pat. No. 9,168,582.

(51) Int. Cl.

| | |
|---|---|
| ***B22D 7/06*** | (2006.01) |
| ***B22D 21/02*** | (2006.01) |
| ***B22D 23/06*** | (2006.01) |
| ***B22D 27/00*** | (2006.01) |
| ***B22D 47/00*** | (2006.01) |
| ***B22D 21/04*** | (2006.01) |

(52) U.S. Cl.

CPC ..... *B22D 7/064* (2013.01); *B22D 7/068* (2013.01); *B22D 9/00* (2013.01); *B22D 21/022* (2013.01); *B22D 21/025* (2013.01); *B22D 21/027* (2013.01); *B22D 21/04* (2013.01); *B22D 23/06* (2013.01); *B22D 27/00* (2013.01); *B22D 27/003* (2013.01); *B22D 47/00* (2013.01)

(56) References Cited

OTHER PUBLICATIONS

Written Opinion of the International Searching Authority of PCT/EP2012/001377.

MACHINE FOR FORMING METAL BARS

This is a continuation application of U.S. patent application Ser. No. 14/859,570, filed Sep. 21, 2015, which is a divisional application of U.S. patent application Ser. No. 14/007,910, filed Oct. 17, 2013, which is the National Stage of PCT/EP2012/001377 filed on Mar. 29, 2012, which claims priority under 35 U.S.C. § 119 of Italian Application No. VI2011A000076 filed on Apr. 1, 2011. The international application under PCT article 21(2) was published in English. The disclosures of the referenced applications are incorporated herein by reference.

The present invention regards a machine for forming metal bars, in particular for producing ingots made of precious metal such as gold, silver, precious alloys, as well as other pure metals or different alloys.

As known, producing ingots, in particular made of gold, silver, precious alloys, other pure metals and different alloys, is usually obtained by means of two different methods.

When producing light ingots, from 5 g up to 50 g, there is used a cold moulding and coining process, starting from semi-finished products, such as cylindrical-shaped preformed pads or billets.

When producing ingots with weight varying between 50 g and 50 Kg there is instead used the melting method and subsequent solidification of the metal in the special moulds. In practice, the metal to be melted is placed within ladles, in form of powders, granules or loose raw materials of various sizes, wherein it is brought to melting. Then the molten metal is poured in single ingot moulds, generally shaped to form a truncated-trapezoid wherein, solidifying, it takes the form of an ingot.

Such two operations, the melting one and the subsequent one for solidifying the material, must be carried out with special care, given that the obtained end-product must meet strict and specific standard requirements.

Actually the ingots available in the market, besides having an exact purity if made of pure metal, or an exact percentage of pure metal if made of an alloy (the so-called "count"), must have extremely precise dimensions and weight, an external configuration with regular surfaces, without depressions or cracks, a uniform coloration and, above all, they must have a perfect internal metal-graphic structure, without blowholes, microporosities and structural tensions.

In order to avoid obtaining faulty ingots not capable of allowing obtaining "punching", which would thus be considered as waste material, it is necessary that the entire production cycle be carried out with much care, in particular during the steps of melting, solidifying and cooling the metal.

An object of the present invention is to provide a machine for forming metal bars, in particular for producing ingots, made of precious and non-precious material and, which does not have the drawbacks revealed by the plants of known type.

The characteristics of the invention will be made more clear through the description of a possible embodiment thereof, provided by way of non-limiting example, with reference to the attached drawings, wherein:

FIG. 1 represents an elevational view of the machine according to the invention; and FIG. 2 represents a detailed view of the ingot mould according to the invention.

As observable from the drawings, the machine according to the invention, generally indicated with reference 100, comprises, by way of example, a station for loading and pushing, indicated with reference 101, the ingot moulds 1 and a melting station for the metal contained in the ingot moulds, indicated with reference 102.

As can be seen in FIG. 1, on a loading surface of the first operating station 101 there are positioned the empty ingot moulds 1, interposing between an ingot mould and the subsequent one or between groups of two or more mutually adjacent ingot moulds, spacers 2, made of graphite or any other refractory material, which have the function of maintaining a predefined distance between the single ingot moulds or between the groups of ingot moulds, in a manner such that the ingot moulds 1, forming a "train of ingot moulds" are positioned, during the forward movement, always correctly within the work area. Furthermore, said operating surface is also provided with a pushing device 3, driven variously, such as by a worm screw, a pneumatic means, hydraulic means or any other means, which provides for pushing, with a predefined "pitch", the aforementioned train forward, and then returning and thus freeing space on the aforementioned loading surface, to allow depositing further empty ingot moulds.

From an operational point of view, in each single ingot mould 1 there is poured an exact weight of metal, in form of powder, grits or swarf of various sizes and there is added a chemical additive, which creates a chemical reaction with the impurities contained in the metal and which is made up of boric acid, borax, potassium nitrates, ammonium, sodium, lithium and potassium and sodium chlorides, used separately or mixed. Lastly, in said first station 101 there occurs the positioning of the cover 4 for closing the filled ingot mould.

According to a preferred embodiment of the invention, as can be seen in the detailed FIG. 2, the ingot mould 1 may have a dimension in height such that, when it is filled with the exact weight of metal, the cover 4 thereof rests on the metal, but remains raised with respect to the abutment of the edge of the ingot mould, this allowing the bottom of the cover to compress and thus regularly compact the powders, the grits or the swarf so that, during the subsequent melting step, when the volume occupied by the mass of metal reduces gradually even up to one third of the initial solid volume, the cover lowers progressively as the metal melts, until it rests on the aforementioned abutment, thus hermetically closing the ingot mould.

Furthermore, the interior space of the ingot mould 1 is made up of two distinct volumes. The lower volume 1.1 constitutes the actual "mould", wherein there are determined the form and the dimensions of the ingot, according to the international standards, such as for example the LMBA standards, or with the other specific requirements of the client and a second upper volume 1.2, which can be differently configured, with the aim of facilitating the deposit of the metal during the loading step.

The invention thus conceived can be subjected to numerous variants and modifications and the construction details thereof can be replaced by technically equivalent elements, all falling within the inventive concept defined by the following claims.

What is claimed is:

1. A method for forming a precious metal ingot having specified dimensions and weight from solid precious metal powder, grits or swarf of various sizes, the specified dimensions of said precious metal ingot includes a dimensionally specified ingot upper limit, said method employing a machine including an ingot mold and a cover for closing said ingot mold, said ingot mold having an interior comprising a first lower volume configured to the specified dimensions of the precious metal ingot, a second upper volume configured to facilitate depositing into said ingot mold of an amount of said solid precious metal powder, grits or swarf of various sizes to form said precious metal ingot, and an upper end comprising an upper abutting edge of said ingot mold, said cover comprising an upper portion and a lower portion, said upper portion including a rim adapted to engage the upper abutting edge of said ingot mold to close and hermetically seal said ingot mold when said precious metal ingot has been formed in said ingot mold first lower volume, said lower portion configured to project into the interior of said ingot mold so as to rest on said amount of solid precious metal powder, grits or swarf ov various sizes deposited in said ingot mold to form said precious metal ingot, said cover lower portion having a dimension such that on engagement of said cover upper portion rim with the ingot mold upper abutting edge, the cover lower portion delineates an upper limit to the ingot mold first lower volume corresponding to the precious metal ingot dimensionally specified upper limit, said method comprising the steps of:

a) depositing into said ingot mold through said second upper volume thereof said amount of solid precious metal powder, grits or swarf of various sizes to form said precious metal ingot;

b) positioning said ingot mold cover for closing said ingot mold such that the cover lower portion projects into the interior of said ingot mold so as to rest on said amount of precious metal powder, grits or swarf of various sizes deposited in said ingot mold, and the cover upper portion rim remains raised with respect to the upper abutting edge of said ingot mold;

c) compacting said solid precious metal powder, grits or swarf of various sizes deposited in said ingot mold by compressing the same during a melting step by the resting of said ingot mold cover on said solid precious metal powder, grits or swarf; and d) progressively lowering said ingot mold cover during the compacting and compressing of said solid precious metal powder, grits or swarf during said melting step until the cover upper portion rim engages the upper abutting edge of said ingot mold closing and hermetically sealing said ingot mold whereby, because of said cover lower portion dimension, the cover lower portion delineates the ingot mold first lower volume upper limit corresponding to the dimensionally specified upper limit of said precious metal ingot.

* * * * *